United States Patent [19]

Daniels

[11] 3,943,699

[45] Mar. 16, 1976

[54] ULTRA THIN ELECTRONIC WATCH

[75] Inventor: R. Gary Daniels, Tempe, Ariz.

[73] Assignee: Motorola, Inc., Chicago, Ill.

[22] Filed: Jan. 13, 1975

[21] Appl. No.: 540,370

[52] U.S. Cl. ..... 58/23 BA; 58/23 R; 58/50 R

[51] Int. Cl.[2] ..... G04C 3/00

[58] Field of Search.. 58/23 R, 23 BA, 50 R, 127 R, 58/126 R; 320/2, 3; D10/29–32, 38

[56] References Cited

UNITED STATES PATENTS

| | | | |
|---|---|---|---|
| 3,505,804 | 4/1970 | Hofstein | 58/23 BA |
| 3,608,304 | 9/1971 | Schaad | 58/23 BA |
| 3,672,155 | 6/1972 | Bergey et al. | 58/50 R |
| 3,757,511 | 9/1973 | Burgess et al. | 58/127 R X |
| 3,854,278 | 12/1974 | Takeshita et al. | 58/50 R |
| 3,855,784 | 12/1974 | Foellner | 58/50 R |

*Primary Examiner*—Ulysses Weldon

*Attorney, Agent, or Firm*—Willis E. Higgins; Harry M. Weiss

[57] ABSTRACT

The thickness of an electronic watch body may be substantially reduced by having portions of the top surface of the watch extend above the remainder of the top surface. Components of the watch which otherwise result in requiring a thick watch body, such as the battery or the display element (e.g., a liquid crystal display), project up into these raised portions.

2 Claims, 3 Drawing Figures

ULTRA THIN ELECTRONIC WATCH

CROSS REFERENCE TO RELATED APPLICATION

A concurrently filed, copending, commonly assigned application Ser. No. 540,371, filed on Jan. 13, 1975, in the name of Daniel W. Mason and entitled "Ultra Thin Electronic Watch With Improved Visibility Display", covers an improvement in the invention described and claimed herein.

FIELD OF THE INVENTION

This invention pertains to an electronic watch. More particularly, it relates to such a watch having a body of substantially reduced thickness. It also desirably relates to such a watch in which a battery powering the watch is easily accessible.

DESCRIPTION OF THE PRIOR ART

Electronic watches are well known at this time and have begun to achieve substantial consumer acceptance. In such watches, a high frequency element, such as a vibrating crystal, is typically employed to give a beat frequency. This frequency is then reduced by frequency divider circuits to frequency values that can be used to indicate time. The outputs of the frequency divider circuits are ultimately used to actuate a time display element, such as a light emitting diode (LED) display or a liquid crystal display (LCD).

While such electronic watches are beginning to make inroads in the watch marketplace, a major problem that has hindered consumer acceptance of present commercially available electronic watches is their overall thickness, which is usually substantially greater than that of conventional mechanical watches. While miniaturized batteries have been developed as power sources for electronic watches, and display elements especially suited for use in electronic watches have also been developed, these components have continued to require a case of substantial thickness to contain them in the watch. It is this problem which is primarily addressed by the present invention.

SUMMARY OF THE INVENTION

Accordingly, it is an object of this invention to provide an electronic watch with a body of reduced thickness.

It is another object of the invention to provide an electronic watch in which the apparent thickness of the watch is not determined by the thickest component utilized in the watch.

It is still another object of the invention to provide a battery operated electronic watch in which access to the battery may be obtained without exposing other components of the watch.

The attainment of these and related objects is achieved through the electronic watch of this invention. The watch has a case with a top surface and a bottom surface. The two surfaces are at least generally parallel to each other, with the distance between the top and bottom surfaces defining a thickness of the watch. There are a plurality of components of differing thickness contained within the case to provide the completed watch. In accordance with the invention, a portion of the top surface of the case extends above the remainder of the top surface. At least the one of the components of greatest thickness of the watch contained within the case extends at least in part into the portion of the top surface extending above the remainder of the top surface of the case. In present day electronic watch technology, the battery and display of the watches constitute the thickest components. It is therefore preferable that both of these components extend in part into portions of the top surface of the case extending above the remainder of the top surface of the case. The portion into which the battery extends is also preferably removable to allow access to the battery.

The attainment of the foregoing and related objects, advantages and features of the invention should be more readily apparent after review of the following more detailed description of the invention, taken in conjunction with the drawing, in which:

DETAILED DESCRIPTION OF THE INVENTION

Figure 1:
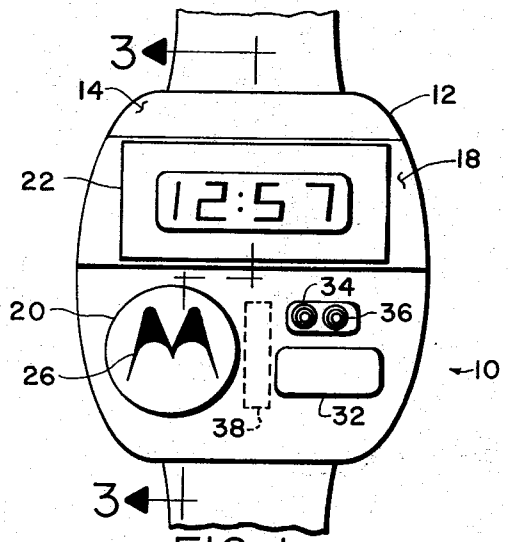
FIG. 1 is a top view of a watch in accordance with the invention.
Figure 2:
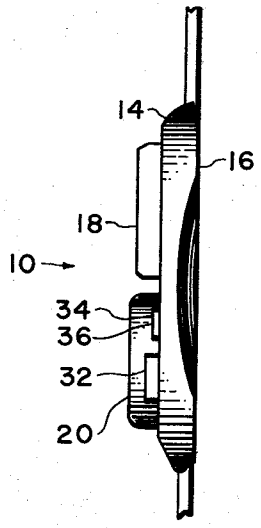
FIG. 2 is a side view of the watch in FIG. 1.
Figure 3:
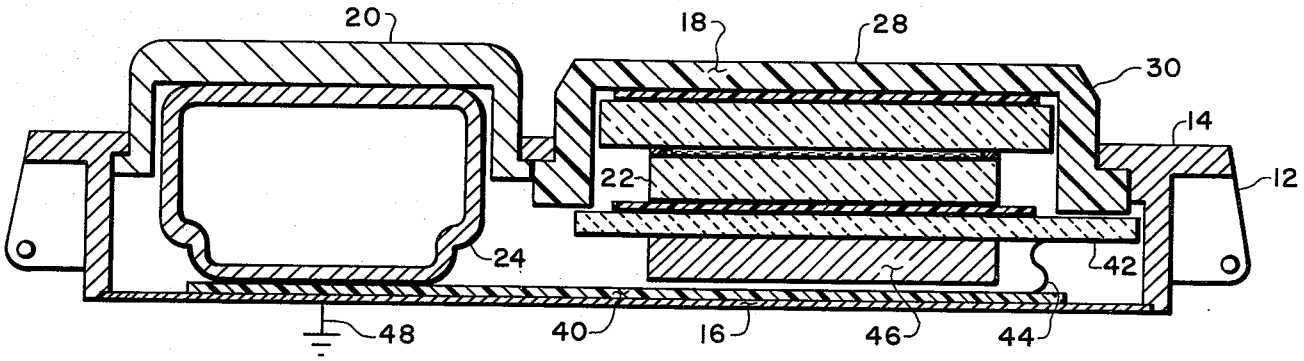
FIG. 3 is an enlarged cross section view of the watch in FIG. 1, taken along the line 3—3.

Turning now to the drawings, more particularly to FIGS. 1–3, there is shown an embodiment of an electronic watch utilizing the invention. The watch 10 has a case 12 with a top surface 14 and a bottom surface 16 (see FIGS. 2 and 3). It can be seen that the top surface 14 and bottom surface 16 define an overall thickness for the main body of the watch.

Portions 18 and 20 extend above the remainder of top surface 14. As is best shown in FIG. 2, LCD 22 extends up into the portion 18. In a similar manner, battery 24 extends up into the raised portion 20.

Raised portion 20 is friction fit into top surface 14 of the watch so that it can be easily removed for access to battery 24. Alternatively, top surface 14 and portion 20 could be screw threaded or keyed for easy removal of portion 20. Raised portion 20 is also a desirable location for a trademark for the watch, such as the stylized M 26, a trademark of Motorola, Inc.

The raised portion 18 having LCD 22 extending into it has a transparent upper surface 28 to allow observation of the LCD. It is preferred that sides 30 of raised portion 18 be transparent as well, in accordance with the teaching of the above referenced copending Mason application, the disclosure of which is incorporated by reference herein, in order to improve visibility of the LCD.

The watch has a demand switch 32 for initiating the display of seconds by LCD 22, rather than hours and minutes as are usually displayed. If desired, the second demand switch 32 may also cause the date to be displayed momentarily after the seconds display has been terminated and before return to the usual hours and minutes. Inset switches 34 and 36 are provided to set the hours and minutes of the watch, respectively. They are actuated by depressing them with a sharp object, such as a pin or a pencil point. The switches 32, 34 and 36 also extend above the top surface 14 of the watch.

A quartz crystal 38 is mounted in the case to the left of seconds demand switch 32. High frequency oscillations of the quartz crystal 38 are divided down to lower frequencies in the watch in order to provide the indication of time. A flexible printed circuit board 40 connects battery 24 and quartz crystal 38 to substrate 42 by means of wire 44. Substrate 42 has one or more integrated circuit chips 46 mounted on one side, which contains frequency divider circuits, decoder circuits and the like necessary for operation of the watch. LCD 22 is connected to the other side of substrate 42. Case 12 is grounded, as shown schematically by connection 48.

Detailed operation of the circuitry and display in the present watch will not be explained, since their operation is known in the art and does not constitute a part of the present invention.

It should now be apparent that an improved electronic watch capable of achieving the stated objects of the invention has been provided. By allowing the battery and LCD of the watch to project into portions of the watch case extending above the top surface of the case, a much thinner watch than is obtainable with conventional electronic watch designs is provided. Access to the battery of the watch may be had through the removable raised portion of the case into which it extends. In this manner, other components of the watch are not exposed when the battery is checked or replaced.

While the invention has been described in detail with reference to a preferred embodiment thereof, it will be apparent to those skilled in the art that various changes in form and details may be made within the spirit and scope of the claims appended hereto. For example, the LCD display may be replaced with another passive display, i.e., one which does not generate light, or a display which does generate light, such as an LED display. It is intended that such modifications be covered within the spirit and scope of the claims appended thereto.

What is claimed is:

1. An electronic watch comprising:

a battery, a display element, electrical circuit means operatively connecting said battery and said display element, a case having top and bottom surfaces at least generally parallel to each other, the distance between the top and bottom surfaces defining a body thickness for said watch, said case having first and second adjacent portions thereof extending above the top surface, said battery extending at least in part into the first portion of said case extending above the top surface, and said display element extending at least in part into the second portion of said case extending above the top surface, and, wherein said first portion of the case extending above the top surface thereof is removable to allow access to said battery.

2. An electronic watch comprising:

a case having a top surface, a display element in said case, a battery, electrical circuit means in said case operatively connecting said battery and said display element, and a removable cover for said battery extending above the top surface of said case, said battery extending at least in part into said removable cover.

* * * * *